US008556112B2

(12) United States Patent
Tujague, Sr. et al.

(10) Patent No.: US 8,556,112 B2
(45) Date of Patent: Oct. 15, 2013

(54) STORAGE MODULE ADAPTER ASSEMBLY FOR MODULAR CONTAINER

(75) Inventors: Stephen L. Tujague, Sr., Covington, LA (US); Eric M. Hediger, Aldie, VA (US); Edward Payne, Hague, VA (US); James E. Stokes, III, Sterling, VA (US); Malcolm Junker, LaMarque, TX (US); Philip J. Dunne, Houston, TX (US); Clarence L. Sockwell, Houston, TX (US); Andrew J. Grygiel, Houston, TX (US)

(73) Assignee: Boh Environmental, LLC, Chantilly, VA (US)

( * ) Notice: Subject to any disclaimer, the term of this patent is extended or adjusted under 35 U.S.C. 154(b) by 48 days.

(21) Appl. No.: 13/050,397

(22) Filed: Mar. 17, 2011

(65) Prior Publication Data

US 2011/0303661 A1 Dec. 15, 2011

Related U.S. Application Data

(60) Provisional application No. 61/315,181, filed on Mar. 18, 2010.

(51) Int. Cl.
*B65D 21/024* (2006.01)
*B65D 90/16* (2006.01)

(52) U.S. Cl.
USPC ..... 220/630; 108/26; 206/386

(58) Field of Classification Search
USPC ..... 220/630, 628, 23.88, 23.87, 23.89, 220/4.33, 4.28, 23.86, 23.83, 23.4, 23.2, 220/1.5, 640, 639, 657, 656, 600; 217/43 A, 217/43 R; 206/600, 598, 386; 29/525.11; 108/26, 25, 56.1, 57.26
IPC ..... B65D 21/028,21/024, 21/02, 90/16, B65D B65D 90/12
See application file for complete search history.

(56) References Cited

U.S. PATENT DOCUMENTS

| | | | | | |
|---|---|---|---|---|---|
| 3,374,915 | A * | 3/1968 | Verhein et al. | ..... | 220/4.28 |
| 3,797,691 | A | 3/1974 | Williams, Jr. | | |
| 4,062,301 | A * | 12/1977 | Pitchford | ..... | 108/56.1 |
| 4,320,845 | A | 3/1982 | Waller | | |
| 4,832,200 | A | 5/1989 | Deaton et al. | | |
| 5,072,845 | A | 12/1991 | Grogan | | |
| 5,105,746 | A * | 4/1992 | Reynolds | ..... | 108/56.1 |
| 5,183,375 | A | 2/1993 | Fenton et al. | | |
| 5,449,081 | A | 9/1995 | Sjostedt et al. | | |
| 5,606,921 | A * | 3/1997 | Elder et al. | ..... | 108/53.3 |
| 5,820,470 | A | 10/1998 | Saunders | | |
| 5,860,369 | A * | 1/1999 | John et al. | ..... | 108/57.26 |
| 6,234,087 | B1 * | 5/2001 | Brown | ..... | 108/56.1 |
| 2007/0158345 | A1 | 7/2007 | Booth et al. | | |
| 2011/0047890 | A1 * | 3/2011 | Lucht | ..... | 52/79.5 |

OTHER PUBLICATIONS

International Search Report and Written Opinion issued in PCT/US11/00482 dated May 14, 2011.

* cited by examiner

*Primary Examiner* — Robert J Hicks
(74) *Attorney, Agent, or Firm* — Bacon & Thomas, PLLC

(57) ABSTRACT

A storage module adapter assembly includes adapter base plates that are two-person portable, can be installed/removed by hand, and cooperate with existing structures of existing modular cargo containers. Each adapter base plate includes various longitudinal and transverse frame members, as well as first and second longitudinal frame members on opposed sides thereof. The first longitudinal frame member has a first height, and the second longitudinal frame member has a second height, which is greater than the first height. Each of the first and second longitudinal frame members also include generally horizontal flange members extending from a top side thereof, such that when two adapter base plates are appropriately positioned side by side, the generally horizontal flange members on the adjacent sides of the two adapter base plates overlap due to the difference between the first and second heights. The adapter base plates can then be connected together by appropriate mechanisms.

22 Claims, 6 Drawing Sheets

FIG. 2
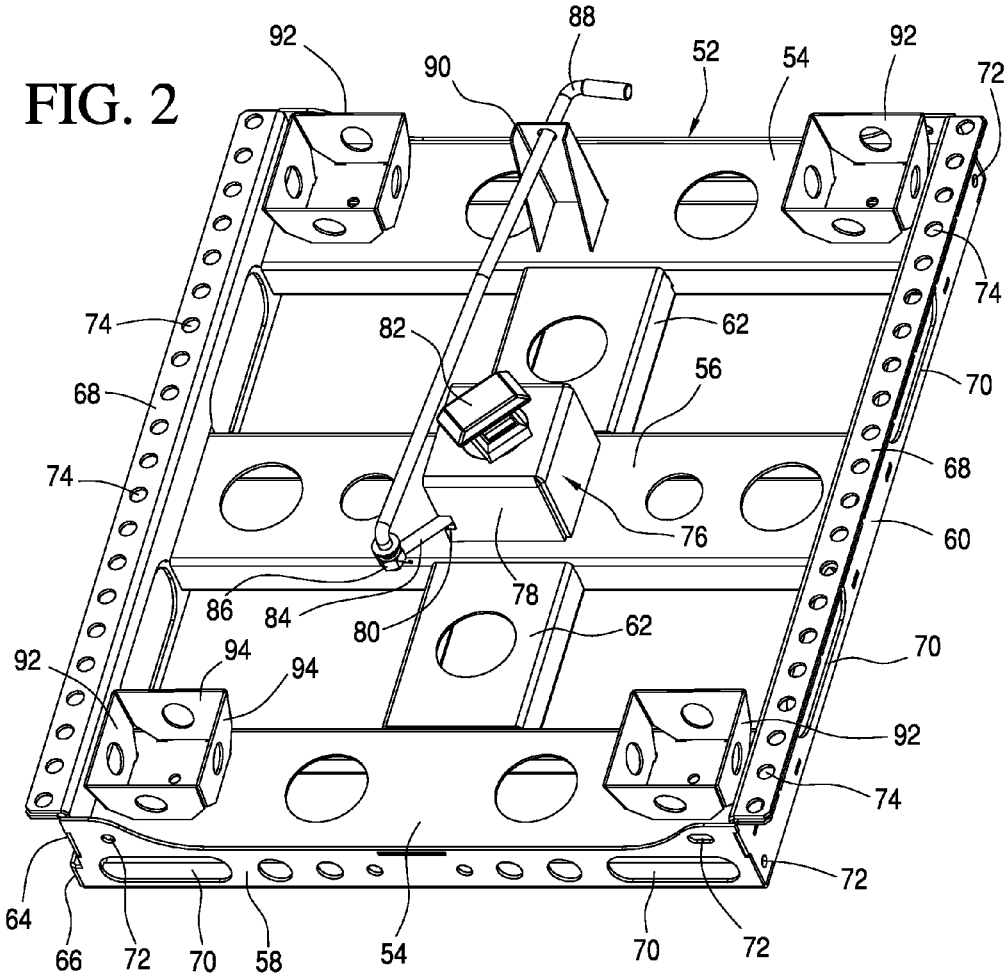
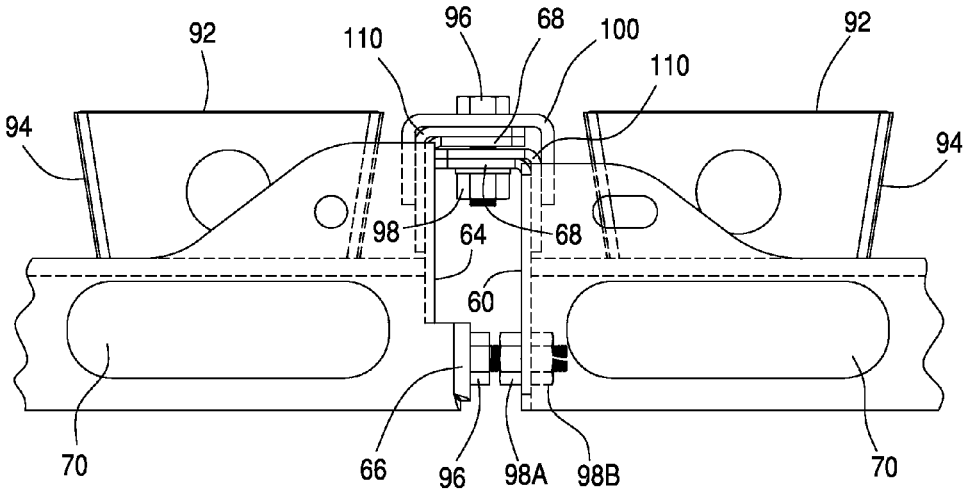
FIG. 3A

STORAGE MODULE ADAPTER ASSEMBLY FOR MODULAR CONTAINER

This application claims the benefit of U.S. Provisional Application No. 61/315,181, filed Mar. 18, 2010.

FIELD OF THE INVENTION

The technology described herein generally relates to receptacles, such as modular cargo containers, and more particularly, to a storage, or cargo, module adapter assembly for modular cargo containers.

BACKGROUND

In recent years, the United States military establishment has rediscovered the importance of being able to safely and efficiently deploy equipment and supplies during foreign expeditions. In particular, the military establishment has realized the benefits of being able to transport and store supplies for units of decreasing size, for example, at the platoon or even squad level.

For hazardous materials, U.S. Pat. No. 4,875,595 issued on Oct. 24, 1989 to Van Valkenburgh discloses a storage enclosure having a containment pan supported on a base frame to allow for visual inspection of the underside of the pan. U.S. Pat. No. 5,356,206 issued on Oct. 18, 1994, also to Van Valkenburgh, discloses another hazardous material storage enclosure with secondary containment shelves that are suspended from a sub-roof assembly.

U.S. Statutory Invention Registration H1477 issued on Sep. 5, 1995 to Payne discloses a mobile containment structure having a plurality of modular shelving units bolted to the floor of the structure for housing and storing cans of paint, drums of lubricant, and the like. U.S. Pat. No. 5,511,908 issued on Apr. 30, 1996 to Van Valkenburgh et al. discloses another mobile safety structure having a removable and grated floor which allows access to a containment pan underneath the floor. U.S. Pat. No. 5,735,739, issued to Payne et al. on Apr. 7, 1998, discloses another mobile safety structure formed by tandem and/or stacked modular units. Finally, U.S. Pat. No. 5,785,591 issued on Jul. 28, 1998 to Payne discloses yet another mobile safety structure with five compartments that are separated by fire-proof walls.

In addition to hazardous materials transport systems, a wide variety of other logistical support systems are now containerized in order to speed troop deployments. As shown in the patents noted above, the military uses a wide variety of specialized containers to not only transport various cargoes in compliance with national and international requirements, but also to store and secure this equipment in the theater of operations. Higher readiness requirements and more limited opportunities for the pre-positioning of military supplies in foreign countries also mean that many military units must store at least some of their supplies in these containers while they are stationed at home between deployments. Since this cargo is often pre-packaged into conventional cardboard boxes which are then stacked side-to-side in end-loaded containers, the entire cargo must often be removed from the container and the boxes in order to locate just one particular item. The leftover boxes must then be collected and disposed of, or recycled, before the container can be reloaded with the remaining stores.

These and other logistical problems can be particularly troublesome for bulk items or "small stores." In this regard, U.S. Pat. No. 4,860,913 to Bertolini discloses a cargo container fitted with a plurality of steel storage cabinets which are integrated into the structure of the container so as to maintain their position and shape when the container is subject to external forces during transportation. In particular, the cabinets are bolted to the side walls of the container, and to each other, with an aisle between them so that articles inside the cabinets can be accessed only by entering through doors at one end of the container, and then opening a particular drawer into the aisle. The cabinet drawers cannot be accessed from outside the container, nor can the cabinets be easily switched from one container to the next.

Each of U.S. Pat. No. 6,299,008, issued to Payne on Oct. 9, 2001, and U.S. Pat. No. 7,185,779, issued to Payne on Mar. 6, 2007, disclose various embodiments of a transport and storage system having removable and interchangeable storage modules for use with a transport and storage device in the form of a standard size (8 foot wide by 8 foot high by 20 foot long ISO) freight container.

The subject matter of each of the patents discussed above is hereby incorporated by reference into the present disclosure.

A problem arises when it is desired to use the above discussed storage modules, which are typically designed for use with specific freight containers, with modular cargo containers, such as tricon or quadcon containers. Such modular cargo containers are designed to have dimensions, such that, when the modular cargo containers are combined (for example, in sets of three or four) the combined modular cargo containers have the same exterior dimensions as a standard size freight container.

There is currently a glut of such modular cargo containers in the world marketplace, but the usefulness thereof is diminished due to the still relatively large interior size of such modular cargo containers. For example, a tricon container will have exterior dimensions of 8 foot wide by 8 foot high by 6 foot 5.5 inches long. Such modular cargo containers are not convenient for storage of smaller, bulk items of cargo, such as, for example, personal equipment.

Given the large number of existing modular cargo containers, and the prohibitive cost of designing and producing replacement containers, there is a need to adapt existing modular cargo containers for use with existing and after developed storage modules without substantial alteration of the structure of the existing modular cargo containers.

SUMMARY

In view of the above discussion, an embodiment of a storage module adapter assembly for securing a storage module to a support surface, such as modular cargo containers, is disclosed.

In use, the disclosed storage module adapter assembly provides an interface between a modular cargo container and a storage module.

The storage module adapter assembly includes adapter base plates that are two-person portable, can be installed/removed by hand, cooperate with existing structures of existing modular cargo containers, and can be installed without alteration of the existing modular cargo containers to be anchored relative thereto, for example, there is no drilling into or welding to the existing structures of existing modular cargo containers.

Each adapter base plate includes various longitudinal and transverse frame members, as well as first and second longitudinal frame members on opposed sides thereof. The first longitudinal frame member has a first height, and the second longitudinal frame member has a second height, which is greater than the first height. Each of the first and second longitudinal frame members also include generally horizontal flange members extending from a top side thereof, such that when two adapter base plates are appropriately positioned side by side, the generally horizontal flange members on the adjacent sides of the two adapter base plates overlap in a nested relationship due to the difference between the first and second heights.

The adapter base plates can then be connected together by appropriate mechanisms, along with two additional adapter base plates, in order to form the storage module adapter assembly. The overlapping nested relationship of the generally horizontal flange members provides a structure along the center of the storage module adapter assembly, when assembled, that provides a solid reinforcement to prevent shifting of storage modules anchored thereto, in particular vertical shifting, under heavy loading conditions.

Once the storage module adapter assembly is assembled together from the adapter base plates, the storage module adapter assembly can be anchored relative to the modular cargo container in which it is positioned, and one or more storage modules can be anchored to the storage module adapter assembly. In this manner, storage modules can be anchored relative to the modular cargo container to prevent vertical and horizontal translation or rotation of the storage modules with respect to both the storage module adapter assembly and the modular cargo container.

BRIEF DESCRIPTION OF THE DRAWINGS

These and other features, aspects, and advantages of the present invention will become better understood with regard to the following description, appended claims, and accompanying drawings where:

FIG. 2 is a perspective view of one adapter plate of the adapter assembly according to the present disclosure;

FIG. 3A is a partial expanded view of taken along line 3A-3A of FIG. 3;

Figure 1:
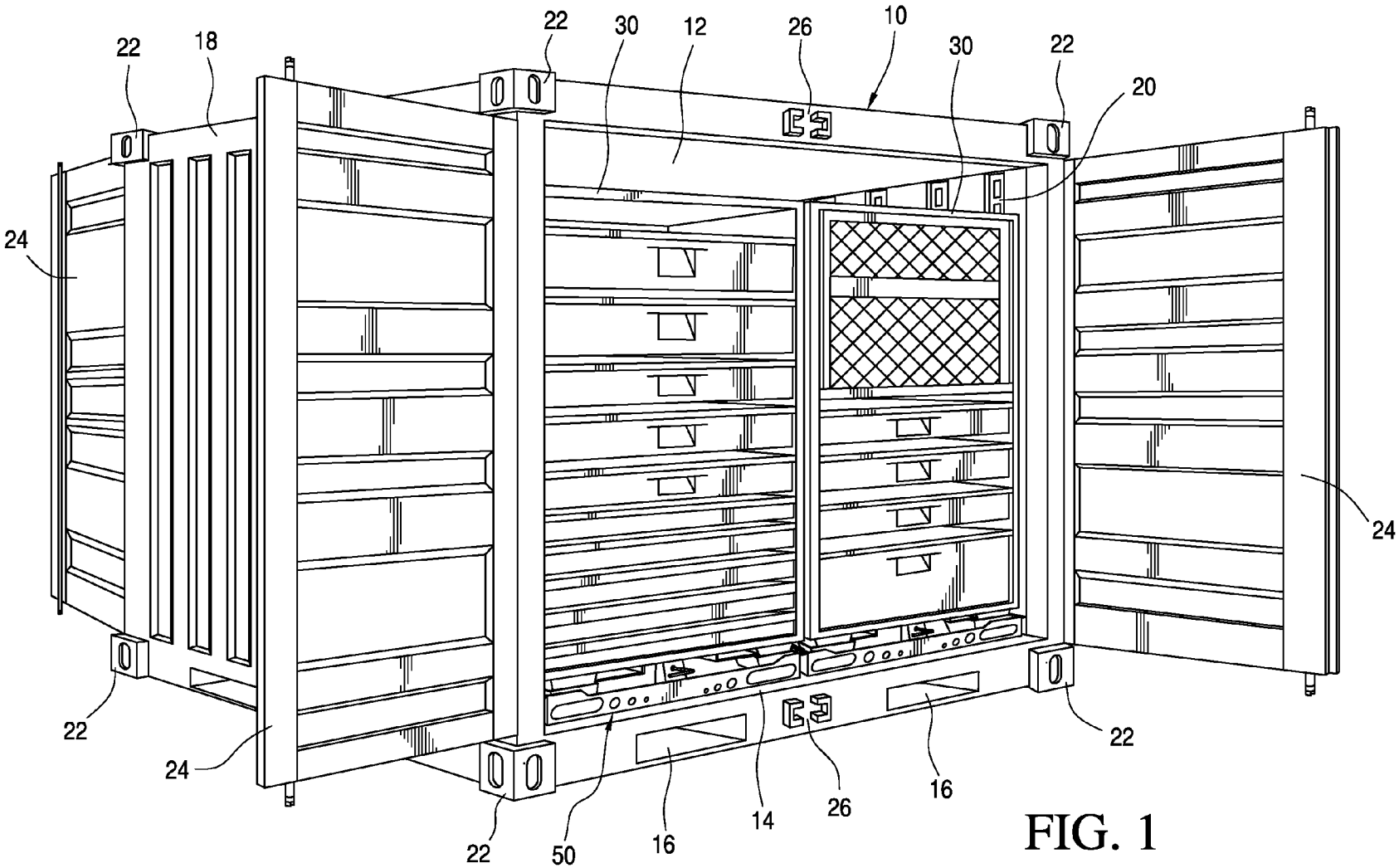
FIG. 1 is a perspective view of a modular cargo container having storage modules retained therein by way of an adapter assembly according to the present disclosure.

It should be noted that the drawing figures are not necessarily drawn to scale, but instead are drawn to provide a better understanding of the components thereof, and are not intended to be limiting in scope, but rather to provide exemplary illustrations. It should further be noted that the figures illustrate exemplary embodiments of a storage module adapter assembly and the components thereof, and in no way limit the structures or configurations of a storage module adapter assembly and components thereof according to the present disclosure.

DETAILED DESCRIPTION

A. Environment and Context

The use of a storage module adapter assembly for a support surface, such as in a modular container or freight container, according to the present disclosure is generally shown in FIG. 1. The modular cargo, or freight, container 10, for example a tricon or quadcon container, generally includes a frame having a top panel 12, side panels 18, and a bottom panel, or support surface, 14 with a generally flat upper surface. Corner fittings 22, which act as lift and anchor points, and can be used to stack, secure, and/or join together multiple modular cargo containers, are provided at the corners of the modular cargo container 10. The modular cargo container 10 may also be used with removable outer panels or with just a frame and no outer panels. Alternatively, panels may be secured to both sides of the frame in order to provide a double-walled structure. The walls may also be insulated. The modular cargo container 10 may also be provided with various ancillary features such as environmental controls, wiring, lighting, plumbing, and/or hazardous materials containment facilities. In this way, the modular cargo container 10 may also be used for other purposes when the storage modules 30 (discussed below) are removed.

The exemplary modular cargo container 10 includes two opposed open sides that can be selectively closed off by the use of hinged doors 24. As shown, a pair of double doors 24 are connected to the modular cargo container 10, and are swingable between open and closed positions. A door latching mechanism 26 is provided, which can allow the doors to be selectively locked in the closed position. It will be recognized that a modular cargo container having only one open side closed off by the use of hinged doors could also be provided.

Forklift pockets 16 are provided at the bottom portion of the frame of the modular cargo container 10 to allow the blades of a forklift to pass therethrough for lifting and lowering of the modular cargo container 10.

Figure 8:
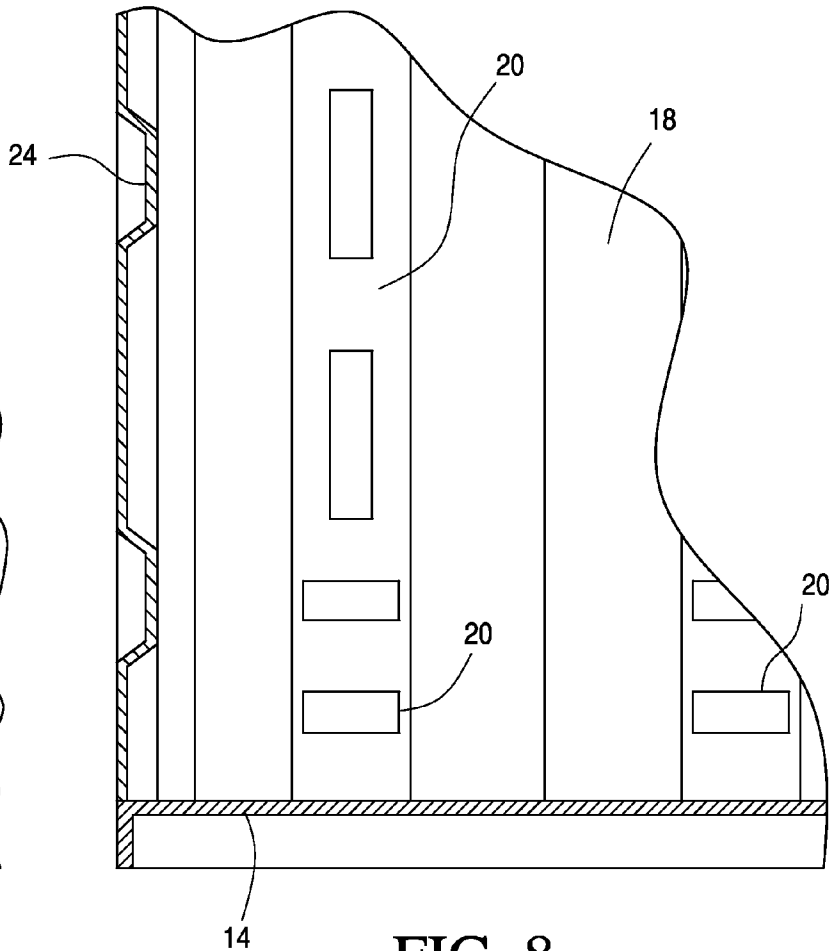
FIG. 8 is a partial expanded cross-section view taken along line 7-7 of FIG. 7.
Figure 7:
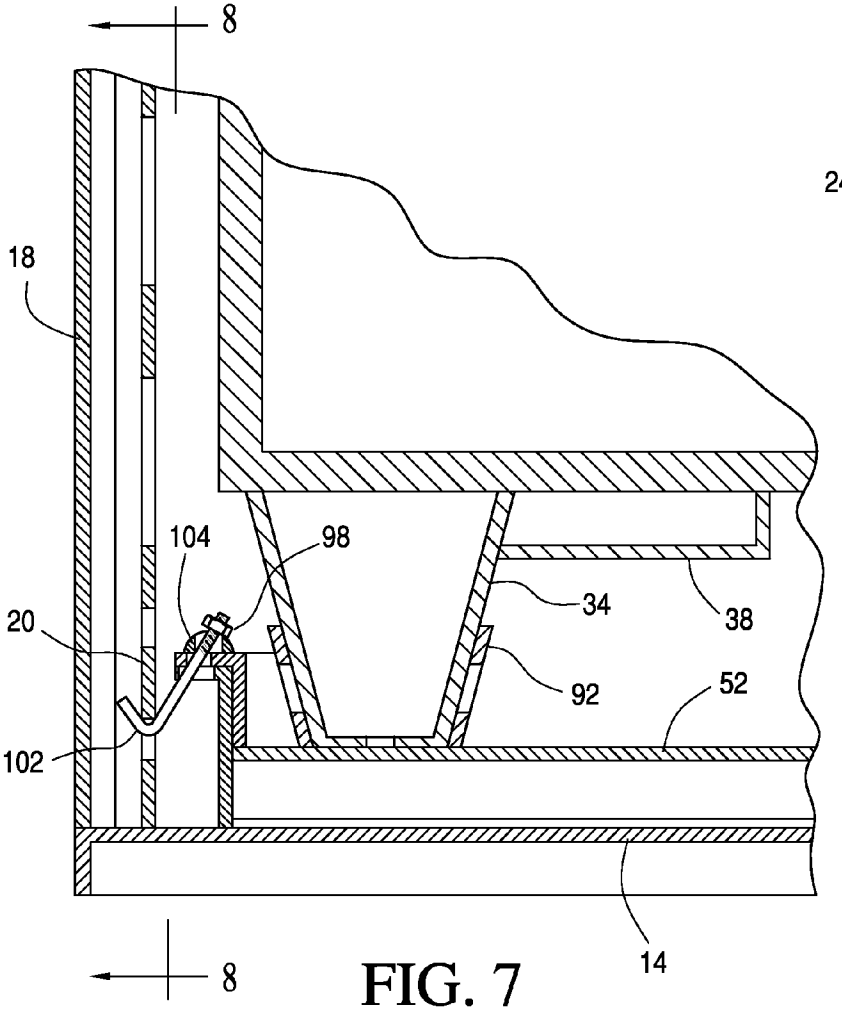
FIG. 7 is a partial expanded cross-sectional view of the storage module, the adapter plate, and the modular storage container, as shown in FIG. 1.

As shown in FIGS. 1, 7, and 8 connection and/or tie down mechanisms 20 are provided in the side panels 18 of the modular cargo container 10. As shown, the connection and/or tie down mechanisms 20 take the form of horizontal and vertical slots formed in internal walls connected to the side panels 18. It will be recognized that any suitable connection and/or tie down mechanisms may be used. The use of the connection and/or tie down mechanisms 20 will be discussed further below, but are generally provided in order to anchor the storage module adapter assembly 50, discussed below, from vertical or horizontal translation or rotation relative to the modular cargo container 10.

As shown in FIG. 1, storage modules 30 are positioned within the modular cargo container 10. While two storage modules 30 are shown side by side, a single larger storage module could be used in place of the two smaller storage modules 30.

The storage modules 30 can be in the form of cabinets. Such cabinets may be arranged with their drawers, shelves, and/or racks opening toward the doors 24 of the modular cargo container 10 for easy access, or with their drawers opening toward the inside of the container for limited access and better security.

Figure 5:
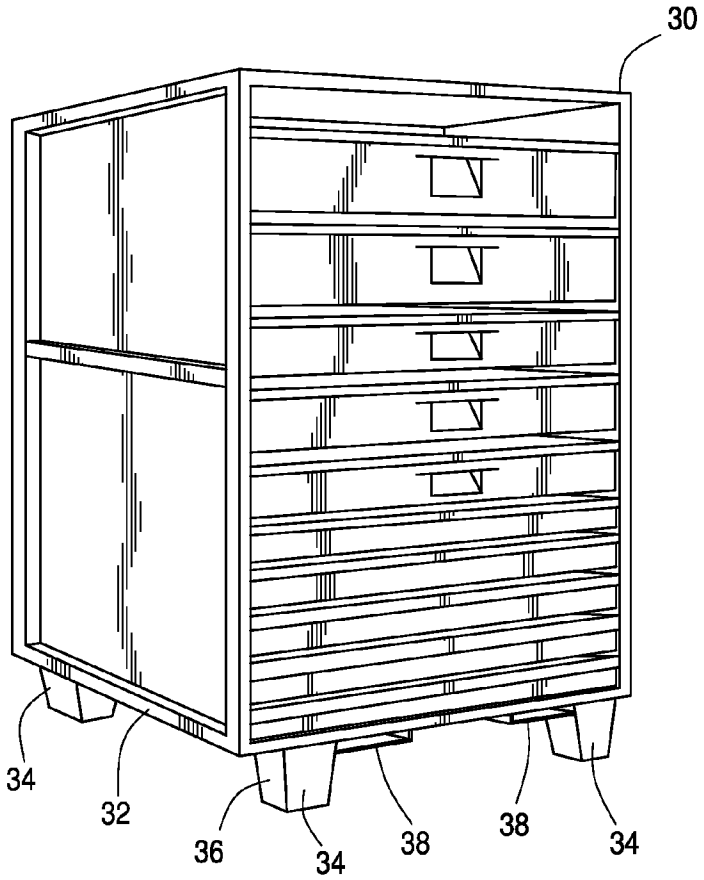
FIG. 5 is a perspective view of an exemplary storage module to be retained in the modular cargo container shown in FIG. 1.

While the storage modules 30 are generally shown in FIGS. 1 and 5 as being in the form of cabinets with doors and/or shelves, the storage modules 30 can take any desired form, such as retractable bins having shelves, chests, boxes, racks, closets, and/or armoires may also be used with the modular storage container 10. The storage modules 30 may also take the form of various habitability modules, such as, but not limited to, offices, kitchens, armories, or decontamination stations.

The storage modules 30 allow various types of cargo to be segregated within the modular cargo container 10. Cargo can also be further segregated in the drawers or shelves of any one particular storage module 30 and/or by dividers inside those drawers. Furthermore the storage modules 30 may be designed to hold a particular type and/or size of cargo. For example, certain storage modules 30 may be used to contain hazardous materials or bulky items while other storage modules contain non-hazardous materials or less bulky items.

Figure 6:
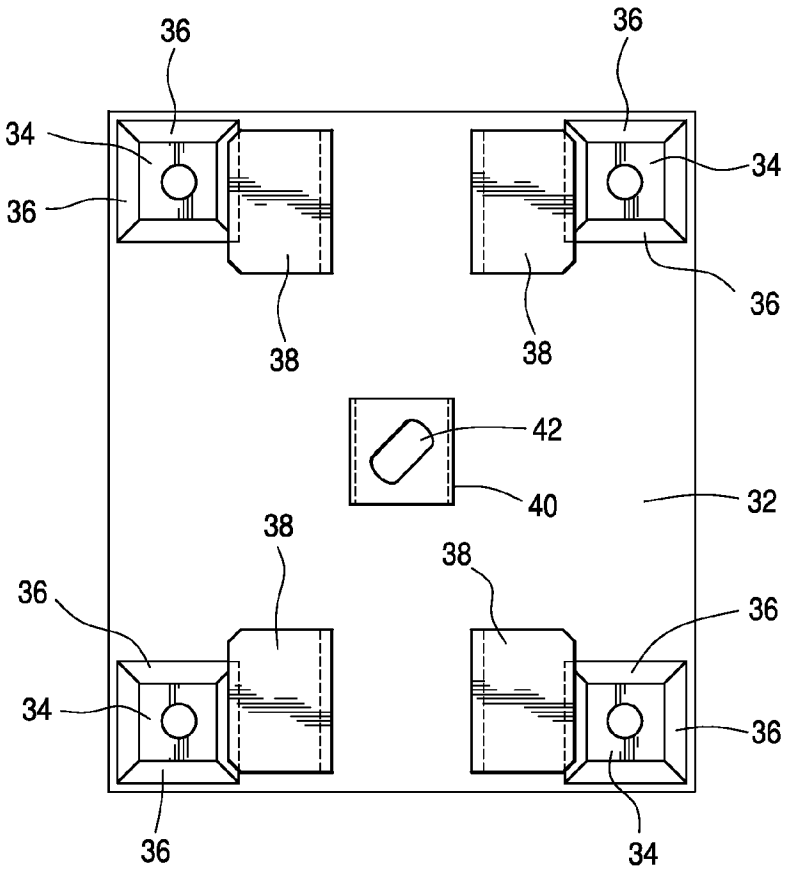
FIG. 6 is a bottom view of the exemplary storage module shown in FIG. 5.

As best seen in FIGS. 5 and 6, in general, storage modules 30 will have a bottom panel 32 having a generally flat bottom surface. Projections, in the form of module feet 34, extend from the bottom surface of the storage module 30. The module feet 34 are shown positioned at the corners of the storage module 30 and having four tapered walls 36. The function of the module feet 34 will be further discussed below.

As shown in FIGS. 5 and 6, forklift pockets or forklift safe zones 38 are also provided on the bottom surface of the storage module 30 to allow the blades of a forklift to pass therethrough for lifting and lowering of the storage module 30 into and out of the modular cargo container 10.

As seen in FIG. 6, a module bracket 40 having an opening 42 therein is also generally centrally provided on the bottom surface of the storage module 30. The module bracket 40 cooperates with a corresponding bracket of the storage module adapter assembly 50, as discussed below.

B. Storage Module Adapter Assembly

As shown in FIG. 1, the storage module adapter assembly 50 provides an interface between the support surface, such as the bottom panel of the modular cargo container 10 and various storage modules 30, without requiring any modification of the existing structure of the modular cargo container 10.

Figure 3:
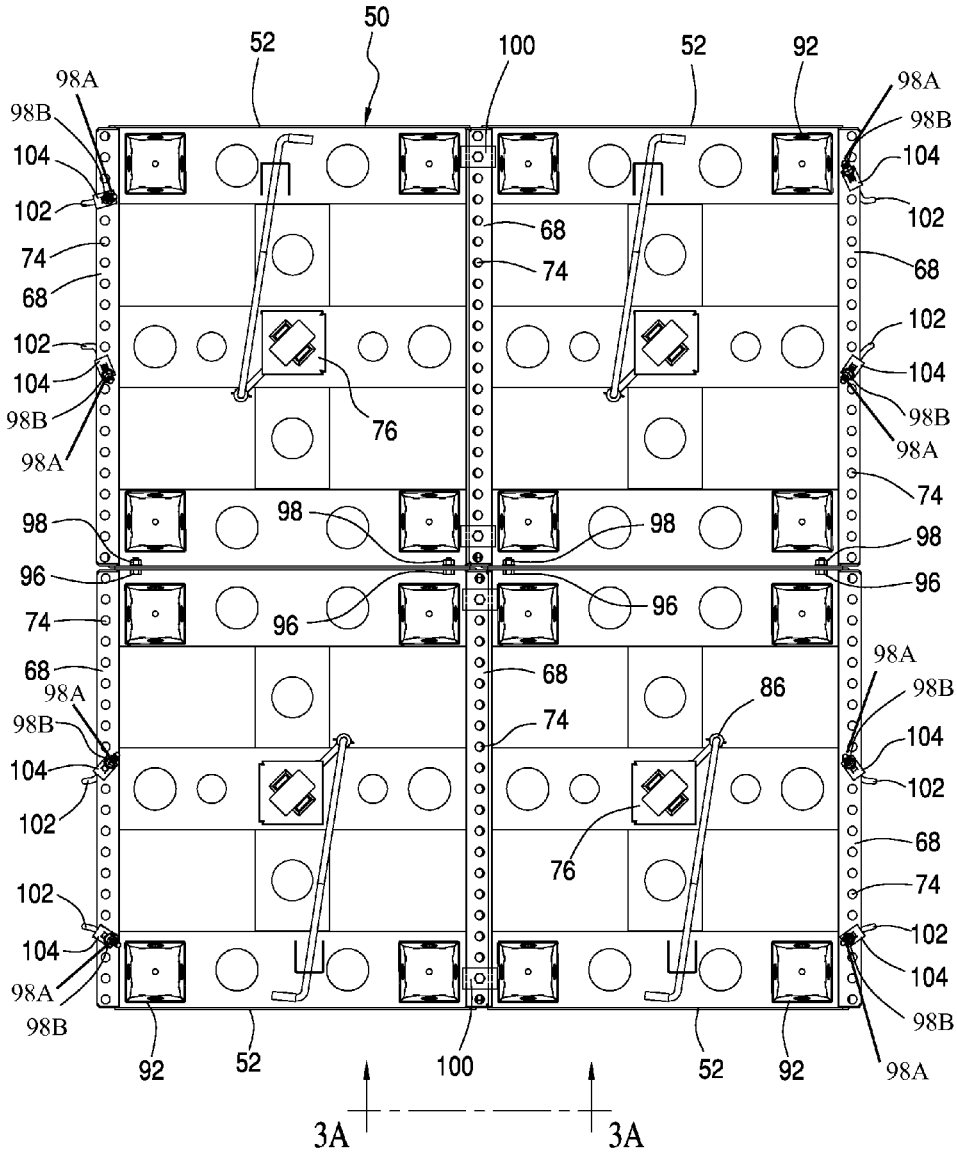
FIG. 3 is a top view of the adapter assembly according to the present disclosure.
Figure 4:
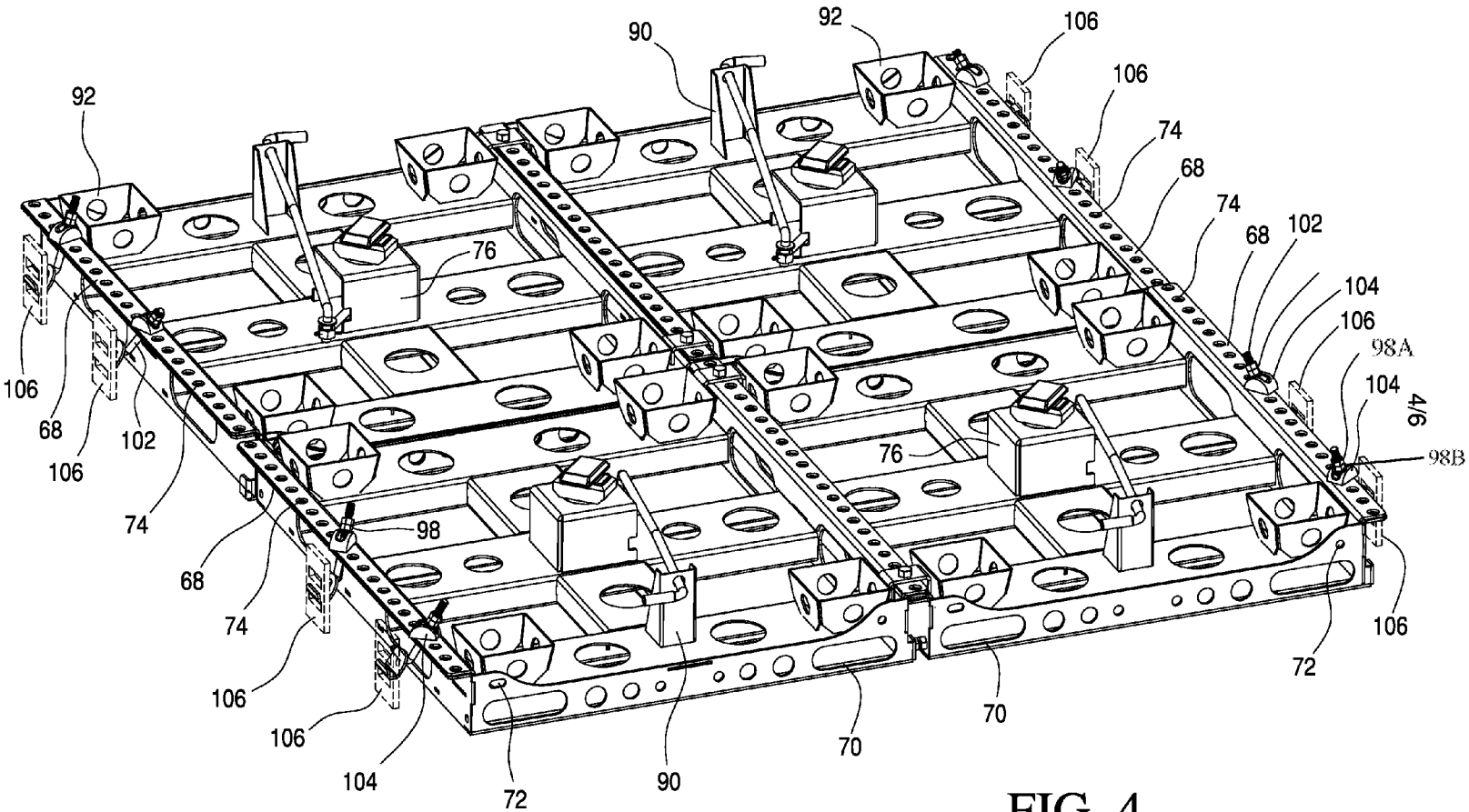
FIG. 4 is a perspective view of the adapter assembly shown in FIG. 3, including anchor plates for anchoring the adapter assembly to a modular cargo container.

As seen in FIGS. 2-4, the storage module adapter assembly 50 is built up from four individual adapter plates 52 (FIG. 2). Each individual adapter plate 52 is lightweight and, thus, can be manipulated by two people into position on the upper surface of the bottom panel 14 (which corresponds to the floor) of the modular cargo container 10. The four individual adapter plates 52 can also be assembled by two people into the storage module adapter assembly 50, in a manner to be discussed below.

As best seen in FIG. 2, an individual adapter plate 52 includes two opposed outer transverse frame members 54, a central transverse frame member 56, and two opposed vertical transverse flange members 58 positioned on the two opposed outer transverse frame members 54. The opposed outer transverse frame members 54, and the central transverse frame member 56 can take any suitable form, but as shown are generally C-shaped box beams having appropriate weight saving cutouts formed therein.

The adapter plate 52 also includes a first longitudinal frame member 60 having a first height, for example 5.0625 inches, central longitudinal frame members 62 (of the same general form as the transverse frame members 54, 56), and a second longitudinal frame member 64 having a second height that is greater than the first height, for example 5.5 inches. The first and second longitudinal frame members 60, 64 are formed as generally plate shaped members, but can take any suitable form.

Generally horizontal flange members 68 extend from the top sides of the first and second longitudinal frame members 60, 64. As will be discussed in detail below, when the adapter plates 52 are assembled together to form the storage module adapter assembly 50, the adjacent horizontal flange members 68 of the respective adapter plates 52 overlap each other in a nested relationship so that the adapter plates 52 can be connected together.

As shown in FIGS. 2, 3, 3A, and 4, in order to allow the adapter plates 52 to be connected together, each generally horizontal flange member 68 has openings 74 formed therein to allow the passage of connection members, such as bolts 96. The openings 74 also allow the passage of anchor members, such as J-bolts 102.

Additionally, each of the vertical transverse flange members 58 and each of the first and second longitudinal frame members 60, 64 have various openings 70, which provide hand holds and/or access to bolt heads for connecting the adapter plates 52 together, as well as connection openings 72 to allow the passage of connection members, such as bolts 96.

As seen in FIGS. 2, 3A, and 4, a connection flange 66 is provided at each end on the bottom side of the second longitudinal frame member 64 to allow a connection member, such as bolt 96, to be held in position for connecting the adapter plates 52 together. The connection flange 66 acts as a pressure plate, which the head of the bolt 96 engages, in order to provide laterally oriented outward pressure at the bottom of the adapter plates 52 once the adapter assembly 50 is assembled and secured to the modular cargo container 10. This outward pressure prevents upward flexure of the assembled adapter assembly 50 at the centerline of the connected adapter plates 52.

As shown in FIG. 3A, reinforcing members 110, having vertical and horizontal flange portions angled together, with connection and/or anchor openings 74 formed in the horizontal flange portions, can be provided over the generally horizontal flange members 68, with the openings 74 thereof in alignment. The reinforcing members 110 add rigidity and support to the first and second longitudinal frame members 60, 64 and the generally horizontal flange members 68.

The method of assembling the adapter plates 52 into the storage module adapter assembly 50 shown in FIGS. 3 and 4 involves taking a first adapter plate and positioning the first adapter plate into position on the upper surface of the bottom panel 14 of the modular cargo container 10, with the second longitudinal frame member 64 thereof aligned adjacent to the side panel 18 of the modular cargo container 10.

Next, a second adapter plate is positioned adjacent to the first adapter plate, with the second longitudinal frame member 64 thereof aligned adjacent to the first longitudinal frame member 60 of the first adapter plate, so that the generally horizontal flange member 68 of the second longitudinal frame member 64 of the first adapter plate extends over the generally horizontal flange member 68 of the first longitudinal frame member 60 of the second adapter plate, such that the connection openings 74 in the generally horizontal flange members 68 are aligned.

As best seen in FIG. 3A, at this time, the first and second adapter plates can be connected together by the use of connection members 96, such as bolts, and associated nuts and washer members. In particular, the first and second adapter plates are connected together at the overlapping, nested, generally horizontal flange members 68 by providing connection members 96, such as bolts, to pass through the connection openings 74 so that the horizontal flange members are in close relationship to thereby enable connection of the first and second adapter plates on the support surface in a manner restraining relative vertical and horizontal movement between the adapter plates. In order to provide resistance against shifting of the first and second adapter plates, a generally C-shaped support 100 can be provided between the connection member 96 and over the overlapping generally horizontal flange members 68. A nut 98 is provided and tightened on the end of the bolt 96 to secure the first and second adapter plates together.

This process is repeated with third and fourth adapter plates, which are positioned within the modular cargo container 10, as discussed above with respect to the first and second adapter plates, and adjacent to the first and second adapter plates. The overlapping, nested, generally horizontal flange members 68 provide a solid reinforcing structure along the center of the storage module adapter assembly 50 that prevents shifting of storage modules 30 connected thereto, in particular, vertical shifting under heavy loading.

Once the third and fourth adapter plates are connected together, using the same process discussed above, they can be further connected to the first and second adapter plates.

In particular, as shown in FIG. 3, connection members 96, in the form of bolts, pass through aligned connection openings 72 in the adjacent vertical transverse flange members 58 of the adjacent adapter plates. Nuts 98 are then tightened to secure the first and second adapter plates to the third and fourth adapter plates.

Alternatively, the third and fourth adapter plates can first be connected to the respective first and second adapter plates, and subsequently connected to each other, in the manners discussed above.

Once the adapter assembly 50 has been assembled within the modular cargo container 10, the adapter assembly 50 can be anchored from vertical or horizontal translation or rotation relative to the modular cargo container 10 using any suitable mechanism that does not alter the existing structure of the modular cargo container 10.

For example, as shown in FIGS. 3, 4, and 7, anchor members 102, for example J-bolts, can be provided to pass through the connection/anchor openings 74 in the generally horizontal flange members. The hook end of the anchor members 102 is arranged to engage a respective slot of the anchoring mechanism 20 of the modular cargo container 10. A generally hemispherical hillside washer 104, and a jam nut 98A and tightening nut 98B are provided at the other end of the anchor members 102 and are tightened down to secure the adapter assembly 50 to the modular cargo container 10.

In a variation shown in FIG. 4, anchor plates 106 can form part of the connection mechanism of the modular cargo container 10, and can be attached at the hook end of the anchor members 102 for cooperative connection therewith.

After the adapter assembly 50 has been anchored from vertical or horizontal translation or rotation relative to the modular cargo container 10, for example, by utilizing anchor members 102, the pressure applying bolts 96 shown in FIG. 3A can be adjusted to apply a laterally oriented outward pressure to the connection flanges 66. Prior to assembly of the adapter assembly 50, the pressure applying bolts 96 of each adapter plate 52 are in a fully retracted position such that the bolt heads thereof are spaced away from the connection flanges 66 when the adapter plates 52 are positioned adjacent to each other for assembly of the adapter assembly 50.

After the assembly 50 has been assembled and anchored, each pressure applying bolt 96, as shown in FIG. 3A, can be adjusted towards the connection flange 66 until firm pressure is applied against the connection flange 66 by the head of the bolt 96. Once the head of the bolt 96 engages the connection flange 66 to apply sufficient pressure, the jam nut 98A and securing nut 98B are properly tightened in order to maintain the bolt 96 in position to maintain the outward pressure on the connection flange 66 to prevent upward flexure of the assembled adapter assembly 50 at the centerline of the connected adapter plates 52. As previously mentioned, the openings 70 formed in the vertical transverse flange members 58 provide access to the nuts 98A, 98B for tightening.

Once the adapter assembly 50 has been anchored from vertical or horizontal translation or rotation relative to the modular cargo container 10, for example, anchored relative to the floor of the modular cargo container 10, the storage modules 30 can be placed into the modular cargo container 10, and anchored thereto.

To accomplish the anchoring of the storage modules 30, as shown in FIG. 2, the adapter plates 52 have a module securing assembly 76 positioned generally centrally thereon, for example, at the central transverse frame member 56. Additionally, receptacles 92 are provided at the corners of the adapter plates 52, corresponding to the projections 34 on the bottom of the storage modules 30. Like the tapered projections 34, the receptacles 92 can be in the form of sockets having tapered walls 94 that complement the tapered projections 34, so that the tapered projections 34 can be received within the receptacles 92 when the storage modules 30 are lowered onto the adapter plates 52.

The centrally positioned module securing assembly 76 corresponds to the centrally positioned module bracket 40 on the bottom of the storage modules 30. The module securing assembly 76 includes an adapter bracket 78, having arm notches 80 formed at two sides thereof, and an adapter securing fitting 82 passing through the adapter bracket 78. An arm 84 is connected to operate the adapter securing fitting 82. A grab handle 88 is operatively connected to the arm 84 at nub 86, and is supported by the grab handle support 90 for manipulation by an operator to anchor the storage modules 30 to the adapter plate 52. The arm notches 80 accommodate the rotational movement of the arm 84.

Suitable adapter securing fittings are available from Tandem Lock, Inc., of Havelock, N.C. Tandem Lock's straight handle twist lock steel, painted, Part No. S38000B-1 PA is illustrated in the figures; however a variety of other securing fittings may also be used. Various other quick-release securing mechanisms could also be used with appropriate modification of the brackets disclosed here. The adapter securing fitting 82 may also be provided with a locking mechanism As discussed above, the module bracket 40 includes an elliptical opening 42 for receiving the corresponding top portion of the adapter securing fitting 82 when the storage module 30 is being anchored. The module bracket 40 may also be replaced by an elliptical opening in the base of the storage modules 30 by shortening the projections 34 on the storage modules 30 and/or raising the height of the adapter bracket 78.

In operation of the adapter securing or clamping fitting 82 for releasably securing the bracket 40 on the storage module 30 to the corresponding bracket 78 on the adapter plate 52, the projections, or feet, 34 of the storage module 30 have already been lowered into the receptacles 92 using a forklift with forks extending through forklift safe zones or pockets 38. As previously discussed, the arm 84 on the adapter clamping fitting 82 may be easily rotated with the aid of a grab handle 88 which engages a nub 86, or other portion of the arm 84, so as to create an easily accessible extension for the arm 84. Rotation of the arm 84 on the adapter clamping fitting 82 causes the head of the adapter clamping fitting to first move vertically through the elliptical hole 42 in the module bracket 40. Once the adapter clamping fitting 82 is fully extended through the elliptical hole 42, further rotation of the arm 84 causes the head of the fitting 82 to rotate and then to retract so that the bottom side of the head abuts the inside surface of the module bracket 40 and clamps the storage module 30 to the corresponding adapter bracket 78 on the adapter 52.

This process is repeated for each storage module 30 to anchor and secure the storage modules to the modular cargo container 10, via the storage module adapter assembly 50. If a single, larger storage module is to be used, such that the size of the storage module is such that more than one adapter plate 52 is encompassed by the storage module, appropriate module brackets 40 can be positioned on the larger storage module for cooperation with each of the adapter securing fittings 82 of the respective adapter plates 52.

In order to remove a storage module 30 from the modular cargo container 10, the process can be reversed to release the module bracket 40 from being secured with the adapter bracket 78, so that the storage module 30 can be lifted from the adapter plate 52 and removed from the modular cargo container 10.

Accordingly, in view of the above discussion, storage modules can be used with existing modular cargo containers, by utilizing the above described storage, or cargo, module adapter assembly. The storage module adapter assembly is conveniently manipulated and assembled by two persons, so that heavy equipment or special tools are not required. Further, the storage module adapter assembly can be anchored to existing modular cargo containers, in order to secure storage modules therein, without the need to modify the existing modular cargo containers, for example, by drilling or welding.

C. Conclusion

It will be recognized that the storage, or cargo, module adapter assembly and components thereof can be made from any suitable materials, such as cold-rolled steel panels, corrosion-resistant steel, aluminum and other metals, and plastic, fiberglass, wood, and/or composite materials. It will also be recognized that the storage, or cargo, module adapter assembly and components thereof can be made to have any suitable size, for example, to be used with different sized modular cargo containers.

While the discussion above details assembling the storage module adapter assembly within the modular cargo container, it will be recognized that the storage module adapter assembly can be assembled outside of the modular cargo container and subsequently lifted into place. The advantage of assembling the storage module adapter assembly within the modular cargo container is that each adapter plate is sufficiently lightweight so that the adapter plates can be manipulated by two persons, thus, providing easier assembly.

Additionally, while the method of assembling the storage module adapter assembly discussed above includes placing the first adapter plate within the modular cargo container with the second longitudinal frame member adjacent to the side panel of the modular cargo container, it will be recognized that the process can be adapted to begin with placing the first adapter plate within the modular cargo container with the first longitudinal frame member adjacent to the side panel of the modular cargo container.

Of course, it is to be understood that not necessarily all objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

The skilled artisan will recognize the interchangeability of various disclosed features from the disclosed embodiments and variations. In addition to variations described herein, other known equivalents for each feature can be mixed and matched by one of ordinary skill in this art to construct a storage module adapter assembly in accordance with principles of the present invention. It will also be recognized that more or fewer connection and anchoring mechanisms than are illustrated may be used.

The use of the word "generally" herein allows for variations in components that arise from, for example, manufacturing processes, or wear and tear during use of components, so that perfectly, for example, flat, straight, horizontal, vertical, longitudinal, transverse components are not required.

Although this invention has been disclosed in the context of exemplary embodiments and examples, it therefore will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above.

What is claimed is:

1. An adapter plate for a storage module adapter assembly configured to be positioned on a support surface of a modular container, comprising:

first and second longitudinal frame members, each of the first and second longitudinal frame members having a generally horizontal flange member that extends an entire length of a top portion thereof, said first longitudinal frame member having a first height, and said second longitudinal frame member having a second height, wherein said first and second longitudinal frame members are configured so that said adapter plate is positionable adjacent at least one of an identical second adapter plate along a support surface of a modular container so that the horizontal flange member of the first longitudinal frame member of the adapter plate overlaps the horizontal flange member of the second longitudinal frame member of the second adapter plate in adjacent nested relationship to thereby enable connection of the two adapter plates together on the support surface in a manner restraining relative vertical and horizontal movement between the adapter plates and with the respective flange members in nested relationship.

2. The adapter plate according to claim 1, including a plurality of sockets at an upper side of the plate configured to receive downwardly extending feet of a storage module to be supported and anchored to the plate.

3. The adapter plate according to claim 2, including a securing assembly for vertically securing a storage module to the plate when the storage module feet are disposed in the sockets.

4. The adapter plate according to claim 1, further comprising a plurality of connection openings provided in each of the generally horizontal flange members, wherein, the adapter plate is configured so that when the generally horizontal flange members of the adapter plate and the second adapter plate overlap to enable connection of the two adapter plates together with the flange members in nested relationship, the connection openings of the overlapping flange members are aligned and capable of receiving at least one connection member.

5. The adapter plate according to claim 4, further comprising at least one connection member arranged to pass through at least one set of aligned connection openings of the overlapping flange members.

6. The adapter plate according to claim 4, further comprising at least one anchor member provided to pass through at least one of the plurality of connection openings.

7. The adapter plate according to claim 6, further comprising an anchor plate attached to the at least one anchor member.

8. The adapter plate according to claim 1, further comprising a connection flange provided at each end on a bottom side of the second longitudinal frame member, wherein the connection flange acts as a pressure plate, such that when the adapter plate and the second adapter plate are positioned adjacent to each other the connection flange is configured so that a head of a bolt is capable of engaging the connection flange in order to provide laterally orientated outward pressure at a bottom of the adapter plates to prevent upward flexure of the adjacent adapter plates.

9. A modular container comprising:

a support surface; and a storage module adapter assembly having at least first and second adapter plates, said first and second adapter plates each having:

first and second longitudinal frame members each having a generally horizontal flange member that extends an entire length of at a top portion thereof;

wherein the storage module adapter is positioned along the support surface so that the first longitudinal frame member of the first adapter plate has a first height, and the second longitudinal frame member of the second adapter plate has a second height such that when the first and second adapter plates are positioned adjacent to each other, the respective generally horizontal flange member of the first longitudinal frame member of the first adapter plate overlaps the horizontal flange member of the second longitudinal frame member of the second adapter plate to thereby allow connection of the two adapter plates together on the support surface in a manner restraining relative vertical and horizontal movement between the adapter plates with the respective flange members in nested relationship;

wherein the storage module adapter assembly is anchored relative to the modular container.

10. The modular container according to claim 9, further comprising:

a storage module which is selectively anchored relative to the modular container by selective anchoring to the storage module adapter assembly.

11. The modular container according to claim 10, further comprising:

a plurality of sockets at an upper side of the at least first and second adapter plates configured to receive downwardly extending feet of the storage module.

12. The modular container according to claim 11, further comprising:

at least one securing assembly for vertically securing the storage module to the storage module adapter assembly when the storage module feet are disposed in the sockets.

13. The modular container according to claim 9, further comprising a plurality of connection openings provided in each of the generally horizontal flange members; and wherein, when the generally horizontal flange members of the two adapter plates overlap to enable connection of the two adapter plates together with the flange members in nested relationship, the connection openings of the overlapping flange members are aligned and capable of receiving at least one connection member.

14. The modular container according to claim 13, further comprising at least one connection member arranged to pass through at least one set of aligned connection openings of the overlapping flange members.

15. The modular container according to claim 13, further comprising at least one anchor member provided to pass through at least one of the plurality of connection openings and arranged to anchor the storage module adapter assembly to the modular container.

16. The modular container according to claim 15, further comprising an anchor plate attached to the at least one anchor member.

17. A storage module adapter assembly configured to be positioned on a support surface of a modular container, comprising:

at least first and second adapter plates each having first and second longitudinal frame members, said first and second longitudinal frame members each having a generally horizontal flange member that extends an entire length of at a top portion thereof, each adapter plate comprising two opposed outer transverse frame members, a central transverse frame member, and two opposed vertical transverse flange members positioned on the two opposed outer transverse frame members, wherein said first longitudinal frame member has a first height, and said second longitudinal frame member has a second height, wherein said first and second longitudinal frame members are positionable so that said first adapter plate is adjacent the second adapter plate along the support surface so that the horizontal flange member of the first longitudinal frame member of the first adapter plate overlaps the horizontal flange member of the second longitudinal frame member of the second adapter plate in adjacent nested relationship to thereby enable connection of the two adapter plates together on the support surface in a manner restraining relative vertical and horizontal movement between the adapter plates with their respective flange members in nested relationship.

18. The storage module adapter according to claim 17, wherein each of the first and second adapter plates further comprise a connection flange provided at each end on a bottom side of the adapter plates, wherein the connection flange acts as a pressure plate such that when the first adapter plate and the second adapter plate are positioned adjacent to each other, the connection flange is configured so that a head of a bolt is capable of engaging the connection flange in order to provide laterally oriented outward pressure at a bottom of the adapter plates to prevent upward flexure of the adjacent adapter plates.

19. The storage module adapter according to claim 17, further comprising a C-shaped support overlapping the horizontal flange member of the first longitudinal frame member of the first adapter plate and the horizontal flange member of the second longitudinal frame member of the second adapter plate and arranged in way such that the C-shaped support further prevents horizontal and vertical movement between the adapter plates.

20. The storage module adapter according to claim 17, wherein the horizontal flange member and first and second longitudinal frame members comprise a plurality of connection openings, each said connection openings being capable of receiving at least one connection member.

21. The adapter plate according to claim 3, wherein said securing assembly for vertically securing a storage module to the plate is centrally located on the adapter plate.

22. The adapter plate according to claim 21, wherein said securing assembly comprises an adapter clamping fitting configured to secure a storage module when the storage module feet are disposed in the sockets, and a rotatable arm configured to cause the adapter clamping fitting to at least move vertically to secure the storage module.

* * * * *